US006860681B2

(12) United States Patent
Ruel

(10) Patent No.: US 6,860,681 B2
(45) Date of Patent: Mar. 1, 2005

(54) SYSTEMS AND METHODS FOR CONNECTING REINFORCING MESH TO WALL PANELS

(75) Inventor: Steven V. Ruel, San Jose, CA (US)

(73) Assignee: SSL, LLC, Scotts Valley, CA (US)

( * ) Notice: Subject to any disclaimer, the term of this patent is extended or adjusted under 35 U.S.C. 154(b) by 0 days.

(21) Appl. No.: 10/370,637

(22) Filed: Feb. 19, 2003

(65) Prior Publication Data

US 2004/0161306 A1 Aug. 19, 2004

(51) Int. Cl.[7] ..... E02D 29/02
(52) U.S. Cl. ..... 405/286; 405/284; 405/262
(58) Field of Search ..... 405/262, 284, 405/286, 302.4, 302.6, 302.7

(56) References Cited

U.S. PATENT DOCUMENTS

| | | | |
|---|---|---|---|
| 979,285 | A | 12/1910 | Gilligan |
| 3,631,682 | A | 1/1972 | Hilfiker et al. |
| 3,922,864 | A | 12/1975 | Hilfiker |
| 4,068,482 | A | 1/1978 | Hilfiker |
| 4,117,686 | A | 10/1978 | Hilfiker |
| 4,154,554 | A | 5/1979 | Hilfiker |
| 4,260,296 | A | 4/1981 | Hilfiker |
| 4,266,890 | A | 5/1981 | Hilfiker |
| 4,324,508 | A | 4/1982 | Hilfiker et al. |
| 4,329,089 | A | 5/1982 | Hilfiker et al. |
| 4,343,572 | A | 8/1982 | Hilfiker et al. |
| 4,391,557 | A | 7/1983 | Hilfiker et al. |
| 4,407,611 | A | 10/1983 | Murray et al. |
| 4,449,857 | A | 5/1984 | Davis |
| 4,505,621 | A | 3/1985 | Hilfiker et al. |
| 4,529,174 | A | 7/1985 | Pickett |
| 4,616,959 | A | 10/1986 | Hilfiker |
| 4,643,618 | A | 2/1987 | Hilfiker et al. |
| 4,661,023 | A | 4/1987 | Hilfiker |
| 4,684,287 | A | 8/1987 | Wojciechowski |
| 4,815,897 | A | 3/1989 | Risi et al. |
| 4,824,293 | A | 4/1989 | Brown et al. |
| 4,834,584 | A | 5/1989 | Hilfiker |
| 4,856,939 | A | 8/1989 | Hilfiker |
| 4,929,125 | A | 5/1990 | Hilfiker |
| 4,952,098 | A | 8/1990 | Grayson et al. |
| 4,961,673 | A | 10/1990 | Pagano et al. |
| 4,992,005 | A | 2/1991 | Hilfiker |
| 4,993,879 | A | 2/1991 | Hilfiker |
| 5,017,050 | A | 5/1991 | Jaecklin |
| 5,028,172 | A | 7/1991 | Wilson et al. |
| 5,044,833 | A | 9/1991 | Wilfiker |
| 5,064,313 | A | 11/1991 | Risi et al. |

(List continued on next page.)

FOREIGN PATENT DOCUMENTS

| | | |
|---|---|---|
| GB | 2059484 | 4/1981 |
| JP | 91-107521/15 | 3/1991 |
| JP | 05033346 A | 2/1993 |

*Primary Examiner*—Sunil Singh
(74) *Attorney, Agent, or Firm*—Michael R. Schacht; Schacht Law Office, Inc.

(57) ABSTRACT

A retaining wall system for stabilizing an earthen wall. The retaining wall system comprises at least one panel structure, at least one anchor mesh panel, and at least one connecting pin. The panel structure comprising a wall panel and at least one insert. The wall panel defines an exposed face and a rear face. A first portion of the insert is embedded within the wall panel. A second portion of the insert extends from the rear face of the wall panel such that the second portion and the rear face of the wall define at least one lock opening. The anchor mesh panel defines a bearing portion and a bearing bar. The anchor mesh panel is arranged such that the bearing bar engages the second portion of the insert and the bearing portion is arranged adjacent to the rear face. The connecting pin is inserted through the at least one lock opening to inhibit relative movement between the anchor mesh panel and the wall panel when loads are applied to the wall panel.

16 Claims, 2 Drawing Sheets

U.S. PATENT DOCUMENTS 5,076,735 A 12/1991 Hilfiker
5,158,399 A 10/1992 Flores
5,190,413 A * 3/1993 Carey ..... 405/286
5,259,704 A 11/1993 Orgorchock
5,484,235 A 1/1996 Hilfiker
5,492,438 A 2/1996 Hilfiker
5,494,379 A 2/1996 Anderson et al.
5,511,910 A 4/1996 Scales
5,531,547 A 7/1996 Shimada
5,564,865 A 10/1996 Jansson
5,622,455 A 4/1997 Anderson et al.
5,642,968 A 7/1997 Anderson et al.
5,647,695 A 7/1997 Hilfiker et al.
5,671,582 A 9/1997 Reay
5,722,799 A 3/1998 Hilfiker
5,749,680 A * 5/1998 Hilfiker et al. ..... 405/262
5,820,305 A 10/1998 Taylor et al.
6,050,748 A 4/2000 Anderson et al.
6,086,288 A 7/2000 Ruel et al.
6,113,317 A 9/2000 Myers
6,402,435 B1 6/2002 Lewis

* cited by examiner

SYSTEMS AND METHODS FOR CONNECTING REINFORCING MESH TO WALL PANELS

TECHNICAL FIELD

The present invention relates to stabilized earthen walls and, more specifically, to a stabilized earthen wall having pre-cast concrete face panels that define a vertical wall face surface.

BACKGROUND OF THE INVENTION

Construction projects often require the formation of vertical or nearly vertical earthen walls. For example, the side of a hill may be excavated to obtain a suitable road grade, leaving a substantially vertical wall face on the uphill side of the road. Depending upon the composition of the earth, stabilization may be required to prevent degradation or collapse of the face of the earthen.

Earthen walls are stabilized using numerous methods. In some situations, a light coating or wire mesh may be applied to the face of the wall to prevent loose dirt and rocks from falling from the exposed wall face. In other situations, the face of the earthen wall may be stabilized by constructing a substantially freestanding wall and backfilling the earth against the freestanding wall. Such freestanding walls are commonly made of materials such as wood or concrete. Wood or concrete may be in the form of blocks or piles that are assembled on site; a freestanding concrete wall may also be cast in place.

In many situations, the earthen wall may require stabilization beyond what can be obtained by a coating, wire mesh, or a freestanding wall. In these cases, the reinforcing wall may be mechanically connected to the earthen wall. This type of reinforcing wall will be referred to herein as a mechanically stabilized earthen wall.

A mechanically stabilized earthen wall typically comprises a substantially vertical face wall and one or more substantially horizontal anchor members connected to the face wall and buried within the earthen wall. The face wall protects the face of the earthen wall, while the anchor members reinforce the face wall.

The present invention relates to mechanically stabilized earthen walls comprising pre-cast concrete panels that form the vertical face surface of the wall.

SUMMARY OF THE INVENTION

The present invention may be embodied as a retaining wall system for stabilizing an earthen wall. The retaining wall system comprises at least one panel structure, at least one anchor mesh panel, and at least one connecting pin. The panel structure comprising a wall panel and at least one insert. The wall panel defines an exposed face and a rear face. A first portion of the insert is embedded within the wall panel. A second portion of the insert extends from the rear face of the wall panel such that the second portion and the rear face of the wall define at least one lock opening. The anchor mesh panel defines a bearing portion and a bearing bar. The anchor mesh panel is arranged such that the bearing bar engages the second portion of the insert and the bearing portion is arranged adjacent to the rear face. The connecting pin is inserted through the at least one lock opening to inhibit relative movement between the anchor mesh panel and the wall panel when loads are applied to the wall panel.

DETAILED DESCRIPTION OF THE INVENTION

Figure 2:
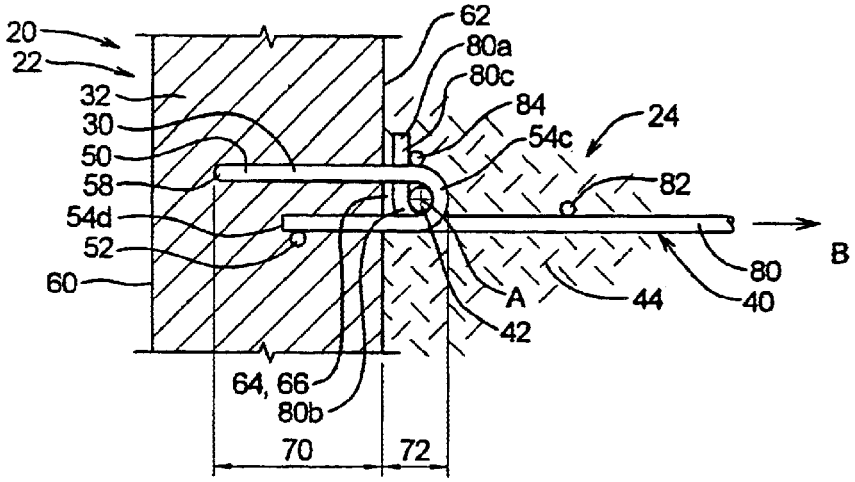
FIG. 2 is a side elevation section view of a wall system comprising the wall insert of FIG. 1 embedded within a wall panel.
Figure 3:
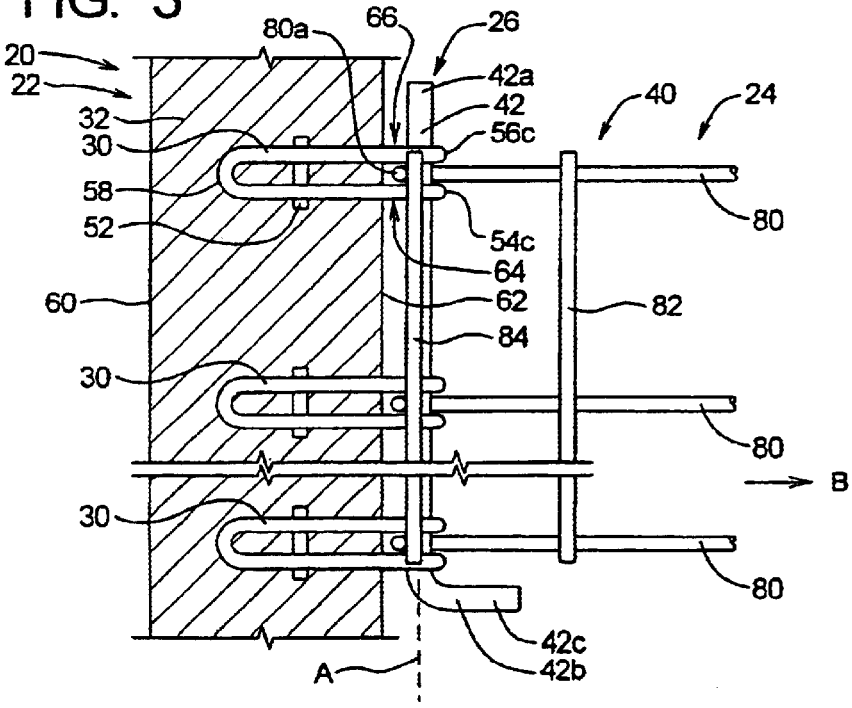
FIG. 3 is a top plan view of wall system of FIG. 2.
Figure 4:
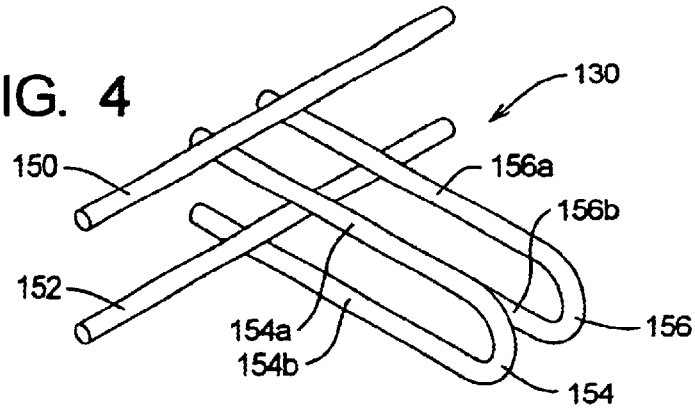
FIG. 4 is a perspective view of another exemplary wall insert constructed in accordance with, and embodying, the principles of the present invention.

Referring initially to FIGS. 2 and 3, depicted therein is a first exemplary retaining wall system 20 constructed in accordance with, and embodying, the principles of the present invention. The retaining wall system 20 comprises a panel structure 22 and an anchor structure 24 connected together by a locking system 26.

The panel structure 22 comprises at least one insert 30 and a wall panel 32. The wall panel 32 is typically made of concrete. The inserts 30 are partly embedded within the concrete wall panel 32 such that each insert 30 is at a predetermined location on the panel 32. Typically, a plurality of inserts 30 are embedded within each wall panel 32. In addition, the inserts 30 are typically arranged at least two vertical levels when the wall system 20 is formed.

The anchor structure 24 comprises an anchor panel 40. The anchor panel 40 is typically a metal structure that is buried within an earthen wall 44.

The locking system 26 comprises a locking pin 42. The locking pin 42 is typically a metal bar.

In use, the panel structure 22 is arranged at a desired location. An earthen wall 44 is formed by backfilling dirt against the wall panel 32. When dirt is backfilled to approximately the vertical level of the insert 30, an anchor panel 40 is arranged on the dirt in a predetermined relationship to the insert 30. The locking pin 42 is then displaced such that the pin 42 engages the insert 30 and,the anchor panel 40 to form the locking system 26 that inhibits relative displacement of the wall panel 32 relative to the anchor panel 40. This process is repeated until the earthen wall 44 reaches a desired level relative to the retaining wall system 20. One or more anchor panels 40 are thus typically provided for one or more of the inserts 30 at each vertical level.

Figure 1:
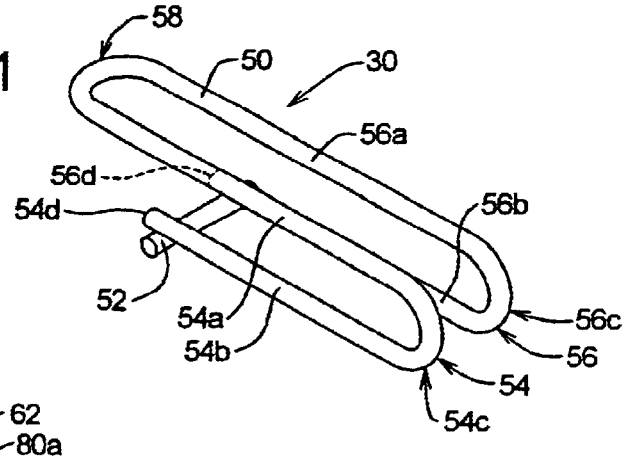
FIG. 1 is a perspective view of an exemplary wall insert constructed in accordance with, and embodying, the principles of the present invention.

Referring now to FIG. 1, the exemplary insert 30 is a welded structure comprising first and second rods 50 and 52. The first rod 50 is bent to form first and second side portions 54 and 56 and a connecting portion 58. The connecting portion 58 is formed by a 180° bend in the first rod 50 that extends between the side portions 54 and 56.

The side portions 54 and 56 comprise upper bar portions 54*a* and 56*a*, lower bar portions 54*b* and 56*b*, and first and second corner portions 54*c* and 56*c*. The upper and lower bar portions 54*a*, 56*a* and 54*b*, 56*b* are substantially straight and substantially parallel to each other. The first and second corner portions 54*c* and 56*c* are formed by 180° bends in the first rod 50. The lower bar portions 54*b* and 56*b* define first and second bar ends 54*d* and 56*d*, respectively.

The second rod 52 is a straight bar that is welded to the lower bar portions 54*b* and 56*b* adjacent to the first and second bar ends 54*d* and 56*d*. Alternatively, an additional 90° bend may be formed in each of the lower bar portions 54*b*and 56*b* such that the first and second bar ends 54*d* and

56*d* may be welded together. In lower load situations, the second rod 52 may be omitted, leaving the bar ends 54*d* and 56*d* unconnected.

The wall panel 32 defines an exposed face 60 and a rear face 62. The inserts 30 are embedded within the panel 32 such that the connecting portion 58 and the bar ends 54*d* and 56*d* are within the panel 32 and the first and second corner portions 54*c* and 56*c* are outside of the panel 32. The upper and lower bar portions 54*a*, 56*a* and 54*b*, 56*b* of the side portions 54 and 56 intersect the rear face 62 of the panel 32. The first and second corner portions 54*c* and 56*c* are thus accessible at the rear face 62 of the wall panel 32. The inserts 30 are not visible from the exposed face 60.

First and second lock openings 64 and 66 are formed by each of the inserts 30 and the rear face 62 of the wall panel 32. In particular, FIGS. 2 and 3 show that, when embedded within the wall panel 32, the inserts define an embedded portion 70 and an exposed portion 72. The embedded portion 70 comprises the second rod 52, part of the upper and lower portions 54*a*, 54*b* and 56*a*, 54*b*, and the connecting portion 58. The exposed portion 72 comprises part of the upper and lower portions 54*a*, 54*b* and 56*a*, 54*b* and the corner portions 54*c* and 56*c*. In conjunction with the rear face 62, the exposed portion 72 defines the lock openings 64 and 66. The lock openings 64 and 66 define a lock axis A.

The anchor panel 40 defines an anchor axis B. The anchor panel 40 may be any structure that, when connected to the insert 30, is capable of preventing movement of the insert 30 relative to the earthen wall under predetermined loads. Typically, the anchor panel 40 is a mesh material made of welded rods. The exemplary anchor panel 40 comprises a plurality of tension rods 80 and plurality of lateral rods 82 welded across the tension rods 80. Dirt forming the earthen wall 44 lies in openings defined by the tension and lateral rods 80 and 82 to inhibit movement of the anchor panel 40 relative to the earthen wall 44.

In addition, the anchor panel 40 comprises a bearing bar 84 welded to the tension rods 80. In particular, the tension rods 80 define proximal ends 80*a* that are, in use, adjacent to the wall panel 32. The tension rods 80 are bent at edge locations 80*b* adjacent to the proximal ends 80*a* to define bearing portions 80*c* of the tension rods 80. The bearing portions 80*c* extend at an angle of approximately 90° in the exemplary system 20, but this angle could be within a first range of approximately 85° to 95° and in any event should be within a second preferred range of approximately 20° to 105°. The bearing bar 84 is welded to the bearing portions 80*c* between the edge locations 80*b* and the proximal ends 80*a*. As will be described further below, the bearing bar 84 engages the inserts 30 to fix a location of the anchor panel 40 relative to the wall panel 32.

The locking pin 42 is an elongate steel bar having first and second ends 42*a* and 42*b*. The exemplary locking pin 42 is bent adjacent to the second end 42*b* to form a handle portion 42*c*.

The formation of the locking system 26 that connects the wall panel 32 and the anchor panel 40 will now be described in further detail. The anchor panel 40 is arranged such that the bearing bar 84 is adjacent to the rear face 62 of the wall panel 32. The bearing portions 80*c* of the tension rods 80 are located between the corner portions 54*c*, 56*c* of the inserts 30 and the rear face 62 of the panel 32.

The handle portion 42*c* of the locking pin 42 is then grasped to displace the locking pin 42 along the lock axis A relative to at least one of the insert members 30 and the anchor panel 40. The first end 42*a* thus passes through the lock openings 64 and 66 between the corner portions 54*c* and 56*c* of the insert 30 and the bearing portions 80*c* of the tension rods 80.

At this point, the locking pin 42 engages the bearing portions 80*c* of the tension rods 80 to prevent movement of the tension rods 80 in the direction of the anchor axis B relative to wall panel 32. The bearing bar 84 engages the insert members 30 to prevent the tension rods 80 from straightening and pulling out from behind the locking pin 42. The locking system 26 thus forms a rigid connection between the anchor panel 40 and the wall panel 32 under normal anticipated loads.

Figure 5:
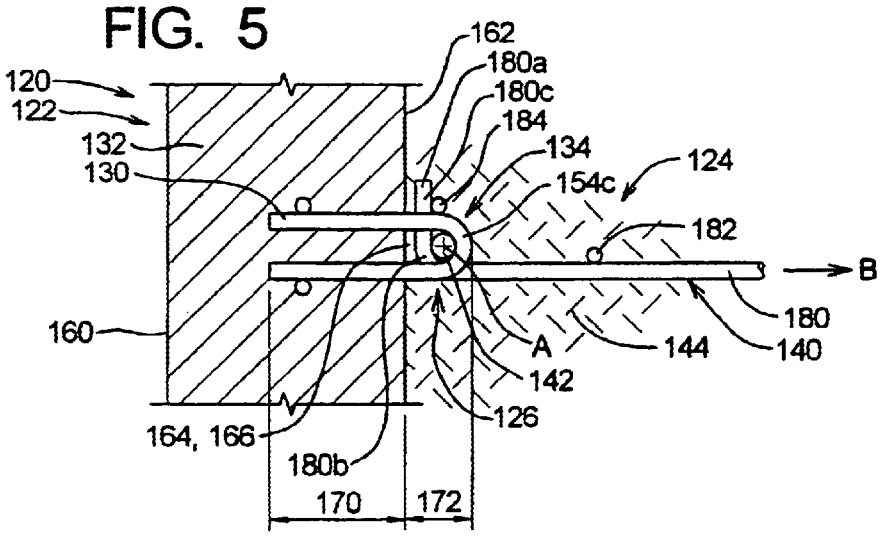
FIG. 5 is a side elevation section view of a wall system comprising the wall insert of FIG. 4 embedded within a wall panel.
Figure 6:
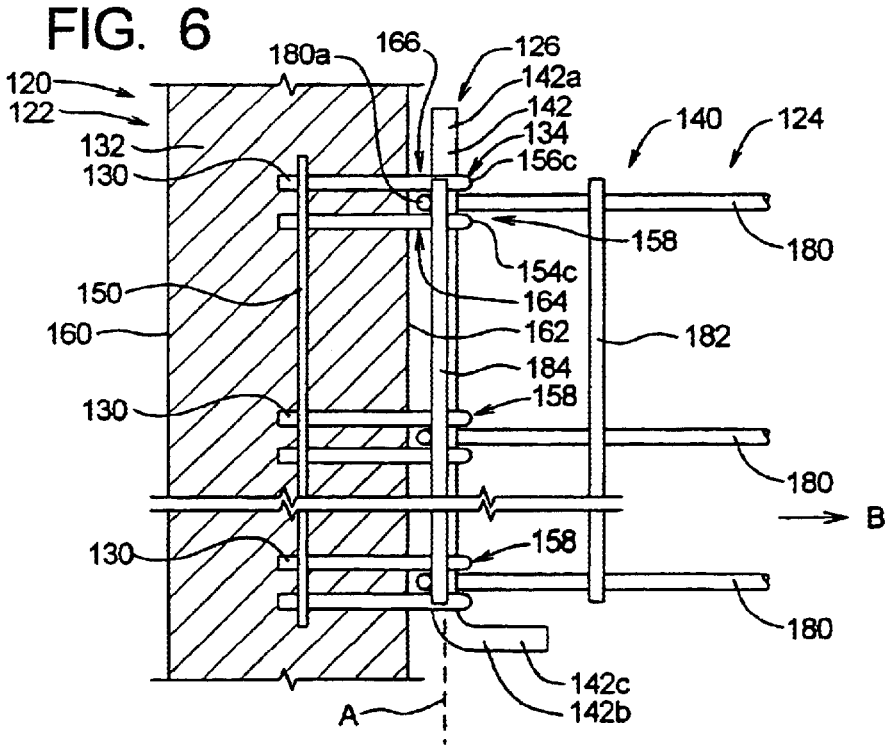
FIG. 6 is a top plan view of the wall system of FIG. 5.

Referring now to FIGS. 5 and 6, depicted therein is a second exemplary retaining wall system 120 constructed in accordance with, and embodying, the principles of the present invention. The retaining wall system 120 comprises a panel structure 122 and an anchor structure 124 connected together by a locking system 126.

The panel structure 122 comprises at least one insert structure 130 and a wall panel 132. The wall panel 132 is typically made of concrete. The insert structure 130 is partly embedded within the concrete wall panel 132 such that one or more insert projections 134 are formed at predetermined locations on the panel 132. Typically, a plurality of insert structures 130 are embedded within each wall panel 132. In addition, the insert projections 134 are typically arranged at least two vertical levels when the wall system 120 is formed.

The anchor structure 124 comprises an anchor panel 140. The anchor panel 140 is typically a metal structure that is buried within an earthen wall 144.

The locking system 126 comprises a locking pin 142. The locking pin 142 is typically a metal bar.

In use, the panel structure 122 is arranged at a desired location. An earthen wall 144 is formed by backfilling dirt against the wall panel 132. When dirt is backfilled to approximately the vertical level of the insert 130, an anchor panel 140 is arranged on the dirt in a predetermined relationship to the insert 130. The locking pin 142 is then displaced such that the pin 142 engages the insert 130 and the anchor panel 140 to form the locking system 126 which inhibits relative displacement of the wall panel 132 relative to the anchor panel 140. This process is repeated until the earthen wall 144 reaches a desired level relative to the retaining wall system 120. One or more anchor panels 140 are thus provided for the one or more insert projections 134 at each vertical level.

The exemplary insert 130 is a welded structure comprising first, second, third, and fourth rods 150, 152, 154, and 156. The first and second rods 150 and 152 are straight rods. The second and third rods 154 and 156 are bent to form upper and lower straight portions 154*a* and 154*b* and 156*a* and 15*b* and corner portions 154*c* and 156*c*. The first rod 150 is welded to the upper portions 154*a* and 156*a* of the first and second rods 154 and 156; similarly, the second rod 152 is welded to the lower portions 154*b*and 156*b* of the first and second rods 154 and 156. Typically, but not necessarily, a plurality of pairs 158 of third and fourth rods 154 and 156 are welded to the first and second rods 150 and 152 as shown In FIG. 6.

The exemplary corner portions 154*c* and 156*c* are formed by 180° bends in the first and second rods 154 and 156. The upper and lower bar portions 154*a*,154*b* and 156*a*,156*b* are, in the preferred system 120 parallel to each other. Similarly, the first and second rods 150 and 152 are preferably parallel to each other and perpendicular to the bar portions 154*a*, 154*b* and 156*a*, 156*b*.

The wall panel 132 defines an exposed face 160 and a rear face 162. The insert structure 130 is embedded within the panel 132 such that the first and second rods 150 and 152 are within the panel 132 and the first and second corner portions 154*c* and 156*c* are outside of the panel 132. The upper and lower bar portions 154*a*, 156*a* and 154*b*, 156*b* intersect the rear face 162 of the panel 132. The first and second corner portions 154*c* and 156*c* of the insert projections 134 are thus accessible at the rear face 162 of the wall panel 132. The insert structure 130 is not visible from the exposed face 160.

First and second lock openings 164 and 166 are formed by each of the insert structures 130 and the rear face 162 of the wall panel 132. In particular, FIGS. 5 and 6 show that, when embedded within the wall panel 132, the insert structures 130 define an embedded portion 170 and an exposed portion 172. The embedded portion 170 comprises the first and second rods 150 and 152 and part of the upper and lower portions 154*a*, 154*b* and 156*a*, 156*b*. The exposed portion 72 comprises part of the upper and lower portions 154*a*, 154*b* and 156*a*, 156*b* and the corner portions 154*c* and 156*c*. The rear face 162 and the exposed portion 172 define the lock openings 164 and 166. The lock openings 164 and 166 define a lock axis A.

The anchor panel 140 defines an anchor axis B. The anchor panel 140 may be any structure that, when connected to the insert 130, is capable of preventing movement of the insert 130 relative to the earthen wall under predetermined loads. Typically, the anchor panel 140 is a mesh material made of welded rods. The exemplary anchor panel 140 comprises a plurality of tension rods 180 and plurality of lateral rods 182 welded across the tension rods 180. Dirt forming the earthen wall 144 lies in openings defined by the tension and lateral rods 180 and 182 to inhibit movement of the anchor panel 140 relative to the earthen wall 144.

In addition, the anchor panel 140 comprises a bearing bar 184 welded to the tension rods 180. In particular, the tension rods 180 define proximal ends 180*a* that are, in use, adjacent to the wall panel 132. The tension rods 180 are bent at edge locations 180*b* adjacent to the proximal ends 180*a* to define bearing portions 180*c* of the tension rods 180. The bearing portions 180*c* extend at an angle of approximately 90° in the exemplary system 120, but this angle could be within a first range of approximately 185° to 95° and in any event should be within a second preferred range of approximately 120° to 105°. The bearing bar 184 is welded to the bearing portions 180*c* between the edge locations 180*b* and the proximal ends 180*a*. As will be described further below, the bearing bar 184 engages the insert projections 134 to fix a location of the anchor panel 140 relative to the wall panel 132.

The locking pin 142 is an elongate steel bar having first and second ends 142*a* and 142*b*. The exemplary locking pin 142 is bent adjacent to the second end 142*b* to form a handle portion 142*c*.

The formation of the locking system 126 that connects the wall panel 132 and the anchor panel 140 will now be described in further detail. The anchor panel 140 is arranged such that the bearing bar 184 is in contact with one of the upper or lower bar portions 154*a*, 154*b* and 156*a*, 156*b* of the insert projections 134. The bearing portions 180*c* of the tension rods 180 are located between the corner portions 154*c*, 156*c* and the rear face 162 of the panel 132.

The handle portion 142*c* of the locking pin 142 is then grasped to displace the locking pin 142 along the lock axis A relative to at least one of the Insert projections 134 and the anchor panel 140. The first end 142*a* thus passes through the lock openings 164 and 166 between the corner portions 154*c* and 156*c* of the insert projections 134 and the bearing portions 180*c* of the tension rods 180.

At this point, the locking pin 142 engages the bearing portions 180*c* of the tension rods 180 to prevent movement of the tension rods 180 in the direction of the anchor axis B relative to wall panel 132. The bearing bar 184 engages the insert projection 134 to prevent the tension rods 180 from straightening and pulling out form behind the locking pin 142. The locking system 126 thus forms a rigid connection between the anchor panel 140 and the wall panel 132 under normal anticipated loads.

The present invention may be embodied in forms other than those described above. In particular, the second bar 52 of the inserts 30 can be elongated and used as part of a plurality of inserts. The plurality of inserts 30 connected by the second bar 52 can be used in a manner similar to that of the insert structure 130 described above. In addition, rather than using both a first rod 150 and a second rod 152, one of these rods could be eliminated. The third and fourth rods 154 and 156 could thus be formed by a single rod like the first rod 50 described above.

The scope of the present invention should thus be determined by the following claims and not the foregoing detailed description.

I claim:

1. A retaining wall system for stabilizing an earthen wall comprising:

at least one panel structure comprising a wall panel defining an exposed face and a rear face, and at least one insert, where the at least one insert defines at least one upper portion, at least one corner portion, and at least one lower portion, portions of the upper and lower portions of the insert member are embedded within the wall panel, and the corner portion extends between the upper and lower bar portions such that the at least one insert and the rear face of the panel define at least one lock opening:

at least one anchor mesh panel comprising a plurality of tension rods each bent at an edge portion at a predetermined angle to define a bearing portion, and a bearing bar secured to the bearing portions of the tension rods and at least one connecting pin; where the anchor mesh panel is arranged such that the bearing bar engages at least one of the upper portion and the lower portion of the insert and the bearing portion is between the corner portion of the insert and the rear face of the front panel;

the connecting pin extends through the at least one lock opening such that the connecting pin directly engages at least a portion of the edge portion of the at least one anchor mesh panel and the corner portion of the insert member, the bearing bar directly engages at least one of the upper and lower portions of the insert member; and when loads are applied to the rear face of the wall panel the engagement of the connecting pin with the edge portion of the at least one anchor panel and the engagement of the bearing bar with at least one of the upper and lower portions of the insert member substantially maintains the predetermined angle at which the bearing portion of the tension rods are bent, thereby inhibiting relative movement between the anchor mesh panel and the wall panel.

2. A retaining wall system as recited in claim 1, in which the insert comprises:

a first rod bent to define the upper portion, the lower portion, and the corner portion; and a second rod welded to at least one of the upper and lower portions; whereby part of the upper and lower portions and the second rod form a buried portion of the insert; and part of the upper and lower portions and the corner portion form an exposed portion of the insert.

3. A retaining wall system as recited in claim 1, in which the insert comprises:

first and second rods;

at least a third rod bent to define the upper portion, the lower portion, and the corner portion; whereby the first and second rods are welded to the upper and lower portions of the third rod, respectively; and the first and second rods and part of the upper and lower portions of the third rod form a buried portion of the insert; and part of the upper and lower portions and the corner portion of the third rod form an exposed portion of the insert.

4. A retaining wall system as recited in claim 1, in which the predetermined angle is less than one hundred and eighty degrees.

5. A retaining wall system as recited in claim 1, in which the predetermined angle is approximately ninety degrees.

6. A retaining wall system as recited in claim 1, in which the anchor mesh panel further comprises at least one lateral rod rigidly connected to, and extending between, the tension rods.

7. A retaining wall system as recited in claim 1, further comprising a plurality of insert members.

8. A retaining wall system as recited in claim 1, in which the at least one insert member further comprising at least one panel rod rigidly secured to one of the upper and lower portions thereof, where the at least one panel rod is embedded within the wall panel.

9. A retaining wall system as recited in claim 8, in which the at least one insert member comprises a plurality of bent rods, where each bent rod defines the at least one upper portion, the at least one corner portion, and the at least one lower portion.

10. A retaining wall system as recited in claim 1, in which the at least one insert member further comprises a plurality of panel rods rigidly secured to one of the upper and lower portions thereof, where the plurality of panel rods are embedded within the wall panel.

11. A retaining wall system as recited in claim 1, in which the at least one insert member further comprises a plurality of panel rods, where one panel rod is rigidly secured to the upper portion and one panel rod is rigidly secured to the lower portion, where the plurality of panel rods are embedded within the wall panel.

12. A retaining wall system as recited in claim 1, in which the at least one insert member comprises a plurality of bent rods, where each bent rod defines the at least one upper portion, the at least one corner portion, and the at least one lower portion.

13. A retaining wall system as recited in claim 12, in which the at least one insert member further comprises at least one panel rod rigidly secured to at least one of the upper and lower portions of each bent rod, where the at least one panel rod is embedded within the wall panel.

14. A retaining wall system as recited in claim 12, in which the at least one insert member further comprises a plurality of panel rods rigidly secured to at least one of the upper and lower portions of each bent rod, where the plurality of panel rods are embedded within the wall panel.

15. A retaining wall system as recited in claim 12, in which the at least one insert member further comprises a plurality of panel rods, where one panel rod is rigidly secured to the upper portion of each of the bent rods and at least one panel rod is rigidly secured to the lower portion of each bent rod, where the plurality of panel rods are embedded within the wall panel.

16. A method of stabilizing an earthen wall comprising:

providing at least one panel structure comprising a wall panel defining an exposed face and a rear face and at least one insert, where the at least one insert defines at least one upper portion, at least one corner portion and at least one lower portion, portions of the upper and lower portions of the insert member are embedded within the wall panel, and the corner portion extends between the upper and lower portions such that the at least one insert and the rear face of the panel define at least one lock opening;

providing at least one anchor mesh panel comprising a plurality of tension rods each bent at an edge portion at a predetermined angle to define a bearing portion and a bearing bar secured to the bearing portions of the tension rods;

providing at least one connecting pin;

arranging the anchor mesh panel such that the bearing bar engages at least one of the upper portion and the lower portion of the insert and the bearing portion is between the corner portion of the insert and the rear face of the front panel;

extending the connecting pin through the at least one lock opening such that the connecting pin directly engages at least a portion of the edge portion of the at least one anchor mesh panel and the corner portion of the insert member and the bearing bar directly engages at least one of the upper and lower portions of the insert member; and applying loads to the rear face of the wall panel such that the connecting pin engages the edge portion of the at least one anchor panel and the bearing bar engages at least one of the upper and lower portions of the insert member to substantially maintain the predetermined angle at which the bearing portion of the tension rods are bent, thereby inhibiting relative movement between the anchor mesh panel and the wall panel.

* * * * *